US006860342B1

(12) United States Patent
Wu et al.

(10) Patent No.: US 6,860,342 B1
(45) Date of Patent: Mar. 1, 2005

(54) TOOL HOUSING WITH PROTECTIVE PADS

(75) Inventors: Simon Wu, Taichung (TW); Chen-Chen Cheng, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 0 days.

(21) Appl. No.: 10/863,052

(22) Filed: Jun. 7, 2004

(51) Int. Cl.[7] ..... B25D 9/00

(52) U.S. Cl. ..... 173/217; 173/170; 173/171; 227/130; 227/156

(58) Field of Search ..... 173/217, 170, 173/171, 162.2; 227/130, 156; D8/68, 69

(56) References Cited

U.S. PATENT DOCUMENTS 3,858,780 A * 1/1975 Perkins et al. ..... 227/8
5,025,970 A * 6/1991 Anderson et al. ..... 227/156
5,085,449 A * 2/1992 Hudson ..... 280/801.1
D338,819 S * 8/1993 Ohkochi ..... D8/69
5,709,332 A * 1/1998 Coop ..... 227/66
5,862,970 A * 1/1999 Cougar ..... 227/130
6,244,358 B1 * 6/2001 Beer et al. ..... 173/178
D477,514 S * 7/2003 Chen ..... D8/68
6,688,407 B2 * 2/2004 Etter et al. ..... 173/170
D491,035 S * 6/2004 Buck ..... D8/68

* cited by examiner

*Primary Examiner*—Scott A. Smith
(74) *Attorney, Agent, or Firm*—Dellett & Walters

(57) ABSTRACT

A tool housing with protective pads for an electrical tool has a housing body and two protectors. The housing body has two sides, a motor housing body and a handle housing body. The handle housing body is formed on the motor housing body. The protectors are mounted respectively on the housing body and each has a first protective pad, a second protective pad and a third protective pad. The pads are made of elastic material, can absorb shocks to prevent the housing body from damaging to improve the useful life of the electrical tool.

1 Claim, 5 Drawing Sheets

TOOL HOUSING WITH PROTECTIVE PADS

BACKGROUND OF THE INVENTION

1. Field of the Invention

The present invention relates to a housing, and more particularly to a tool housing with protective pads for an electrical tool and that has an strengthened structure.

2. Description of Related Art

An electrical tool substantially comprises a housing, a tool head, a transmitting device and a motor. The tool head is mounted to the tool housing and has a shaft rotatably mounted on the tool head. The shaft has a distal end extending outside the tool housing and connected to a tool, such as a drill. The transmitting device is held in the housing and is mounted between the motor and the tool head. The motor is mounted inside the housing to drive the shaft to rotate by means of the transmission of the transmitting device.

However, because the electrical tool must be held by hand when the tool is in use, the electrical tool is easy to bump with adjacent objects or to fall off from a hand due to carelessness of a user. Therefore, the housing is easily to wear or damage, and the motor and the transmitting device have precise structures are also easy to fail or damage. Furthermore, when the electrical tool is put on a table or a floor with the housing contacting the table or the floor directly, the housing is also easy to rub against the table or the floor and is damaged.

To overcome the shortcomings, the present invention tends to provide a housing with protector for an electrical tool to mitigate or obviate the aforementioned problems.

SUMMARY OF THE INVENTION

The main objective of the invention is to provide a tool housing with protective pads for an electrical tool to enhance the structure of the tool housing and to prevent the housing from rubbing againstadjacent objects.

The tool housing with protective pads in accordance with the present invention comprises a housing body and two protectors. The housing body has two sides, a motor housing body and a handle housing body. The handle housing body is integrally connected with the motor housing body. The protectors are mounted respectively on the sides of the housing body.

Other objects, advantages and novel features of the invention will become more apparent from the following detailed description when taken in conjunction with the accompanying drawings.

DETAILED DESCRIPTION OF THE PREFERRED EMBODIMENTS

Figure 1:
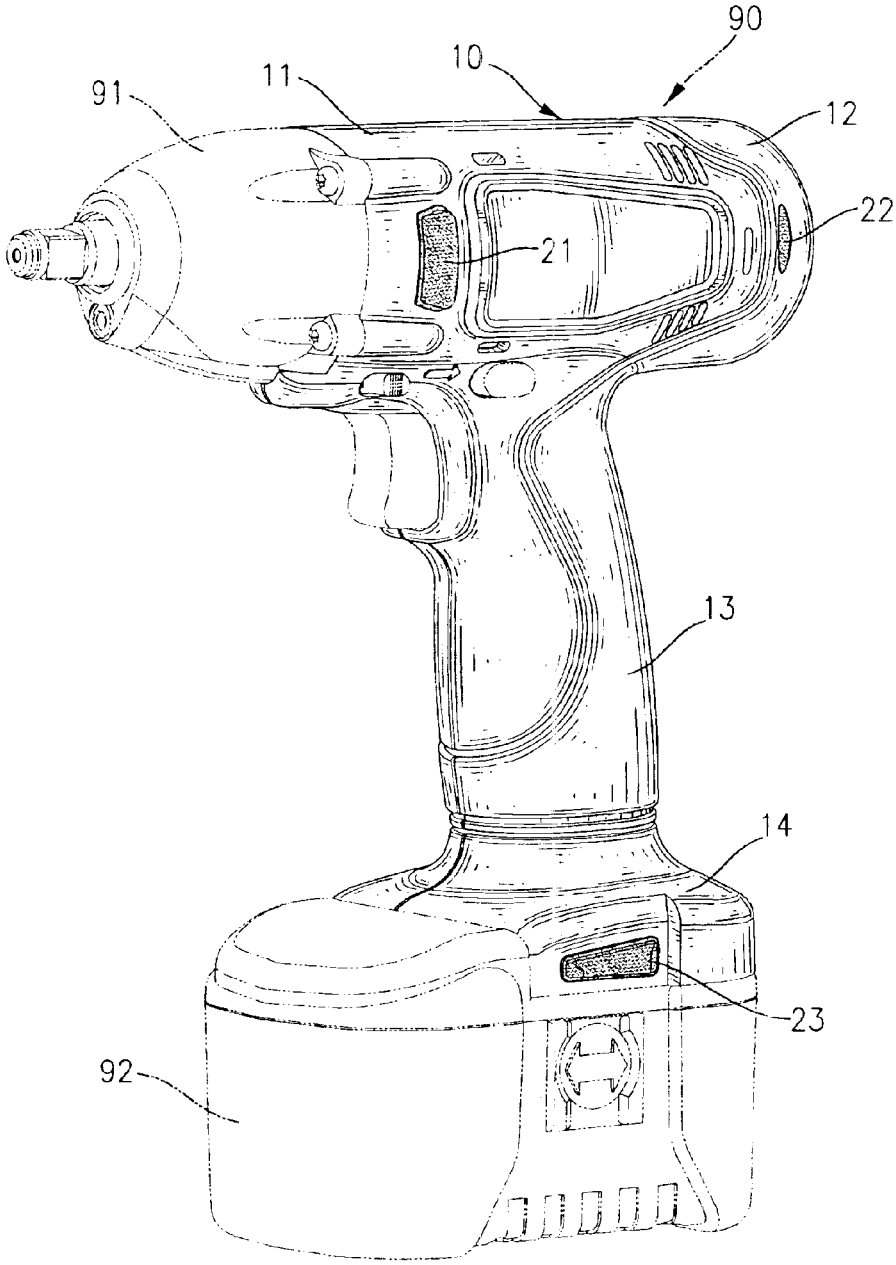
FIG. 1 is a perspective view of an electrical tool with a tool housing with protective pads in accordance with the present invention.
Figure 2:
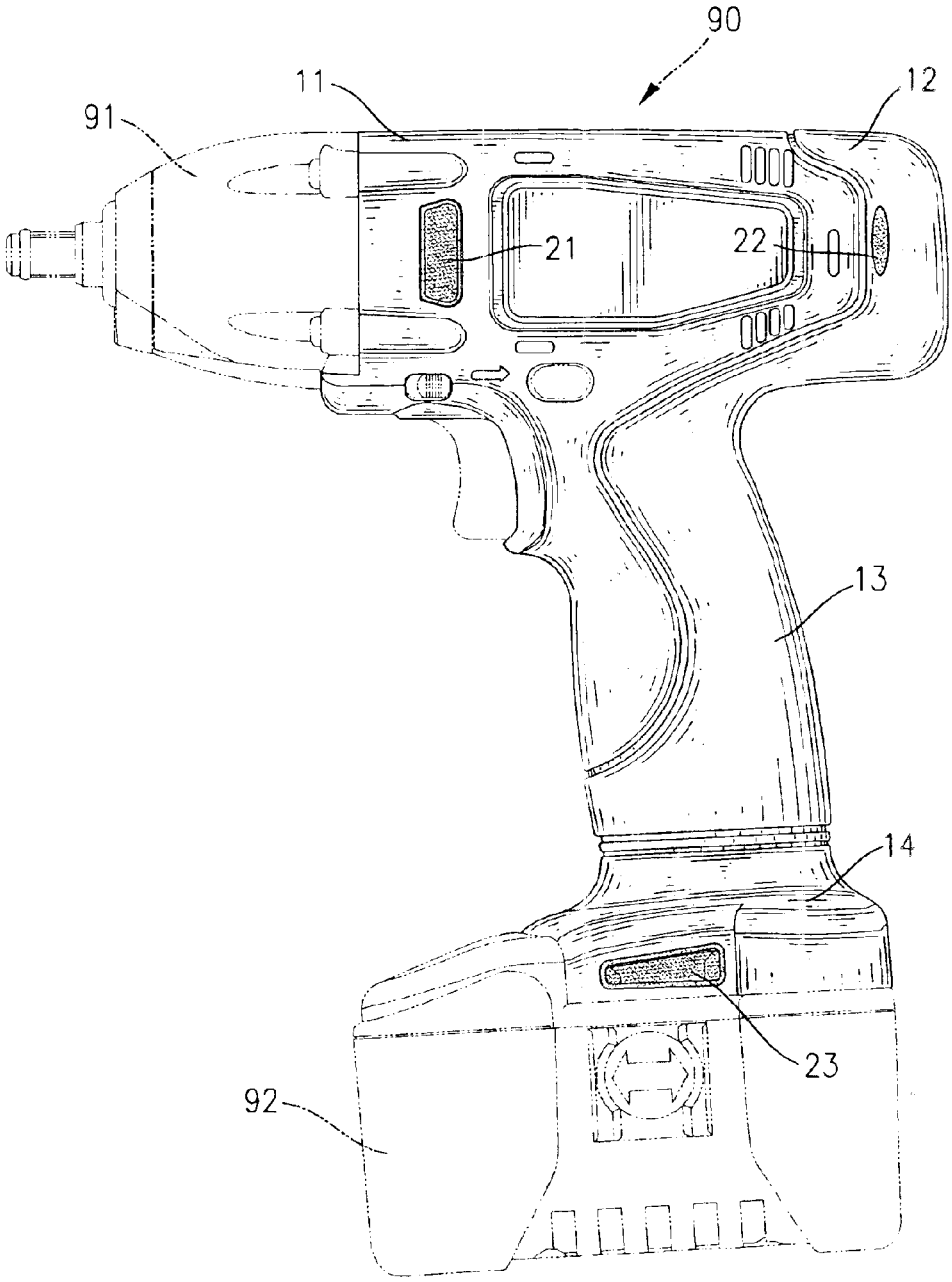
FIG. 2 is a side view of the electrical tool with the tool housing in FIG. 1.
Figure 3:
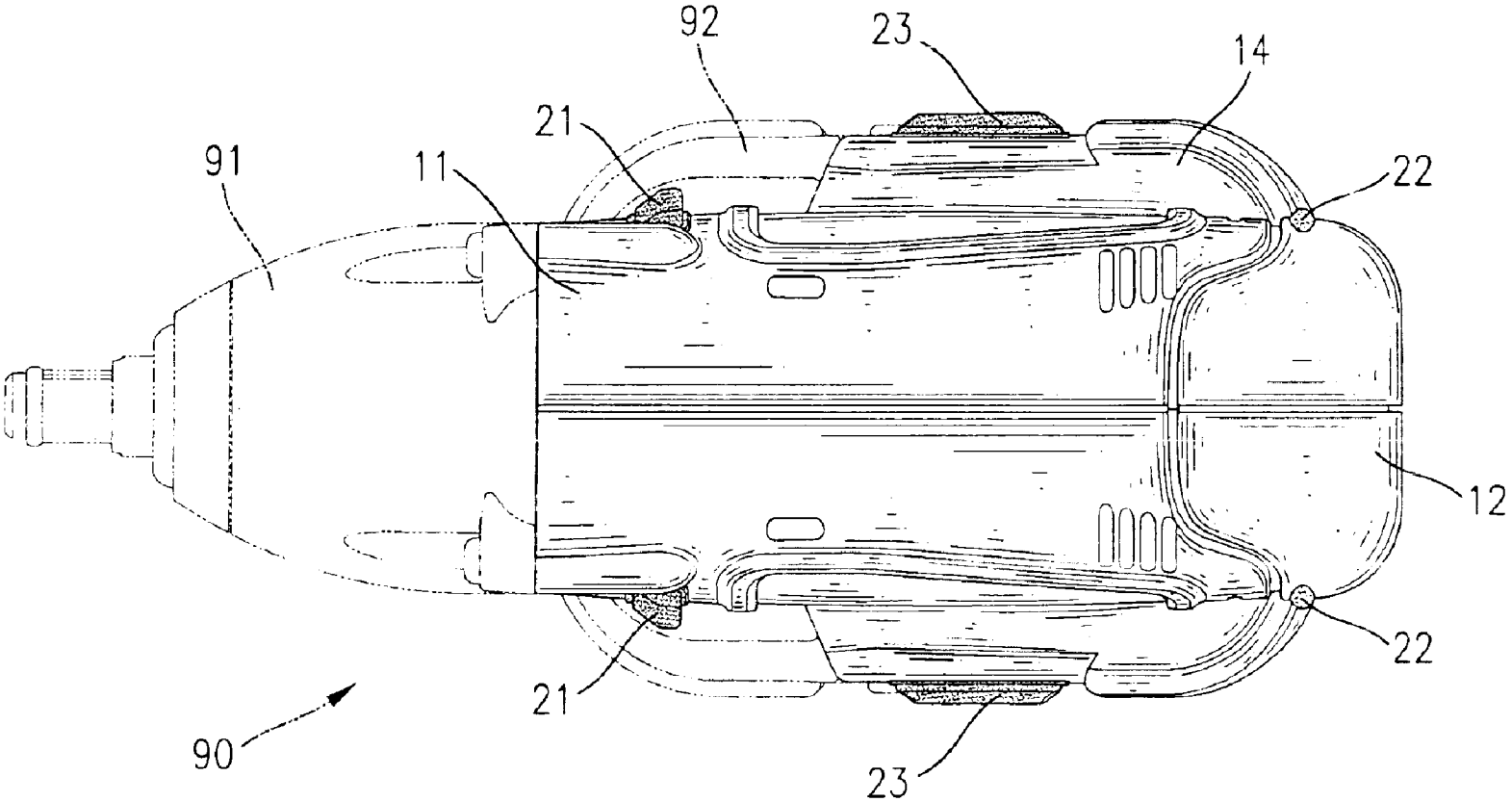
FIG. 3 is a top view of the electrical tool with the tool housing in FIG. 1.
Figure 4:
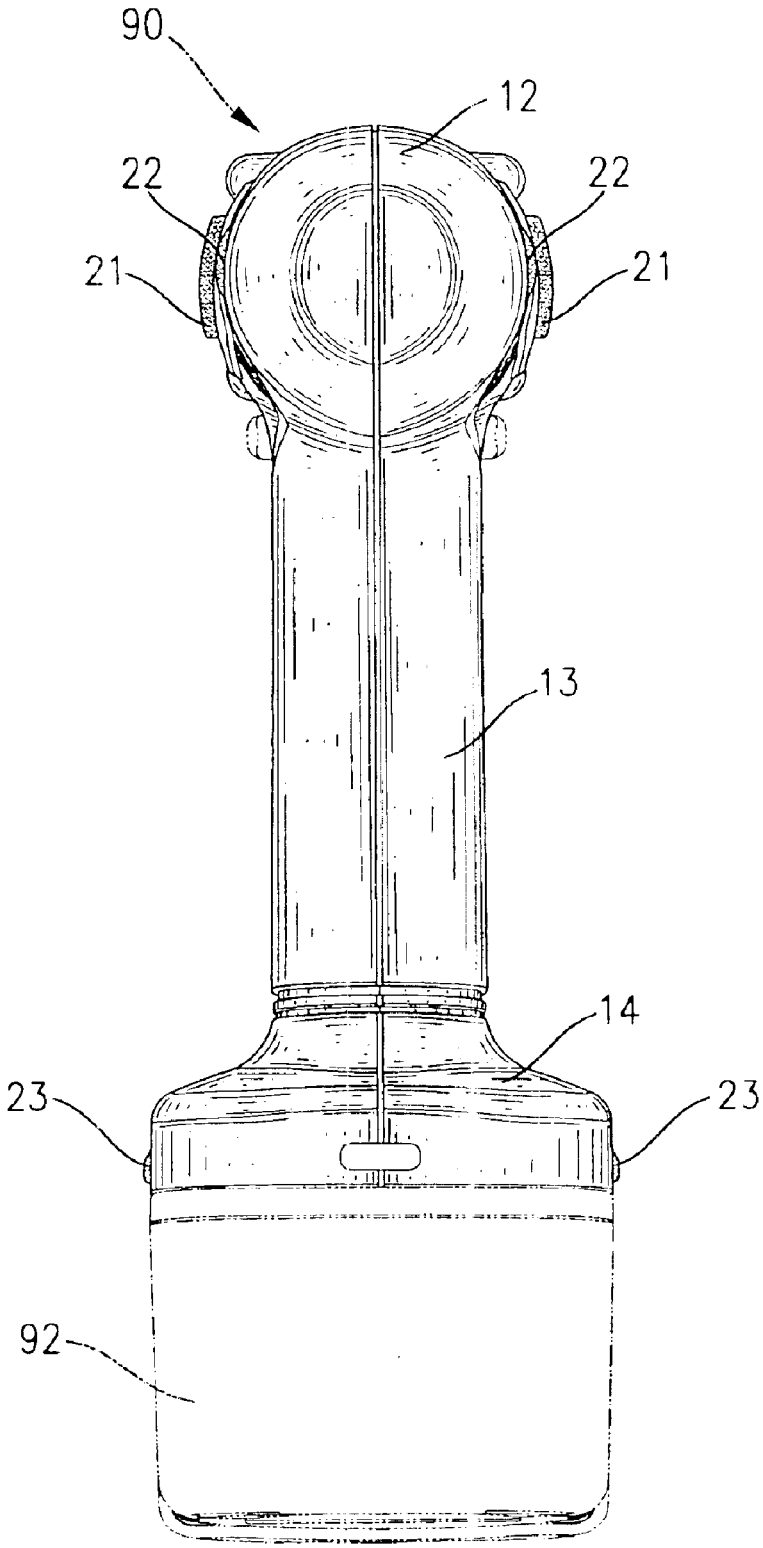
FIG. 4 is a rear view of the electrical tool with the tool housing in FIG. 1.
Figure 5:
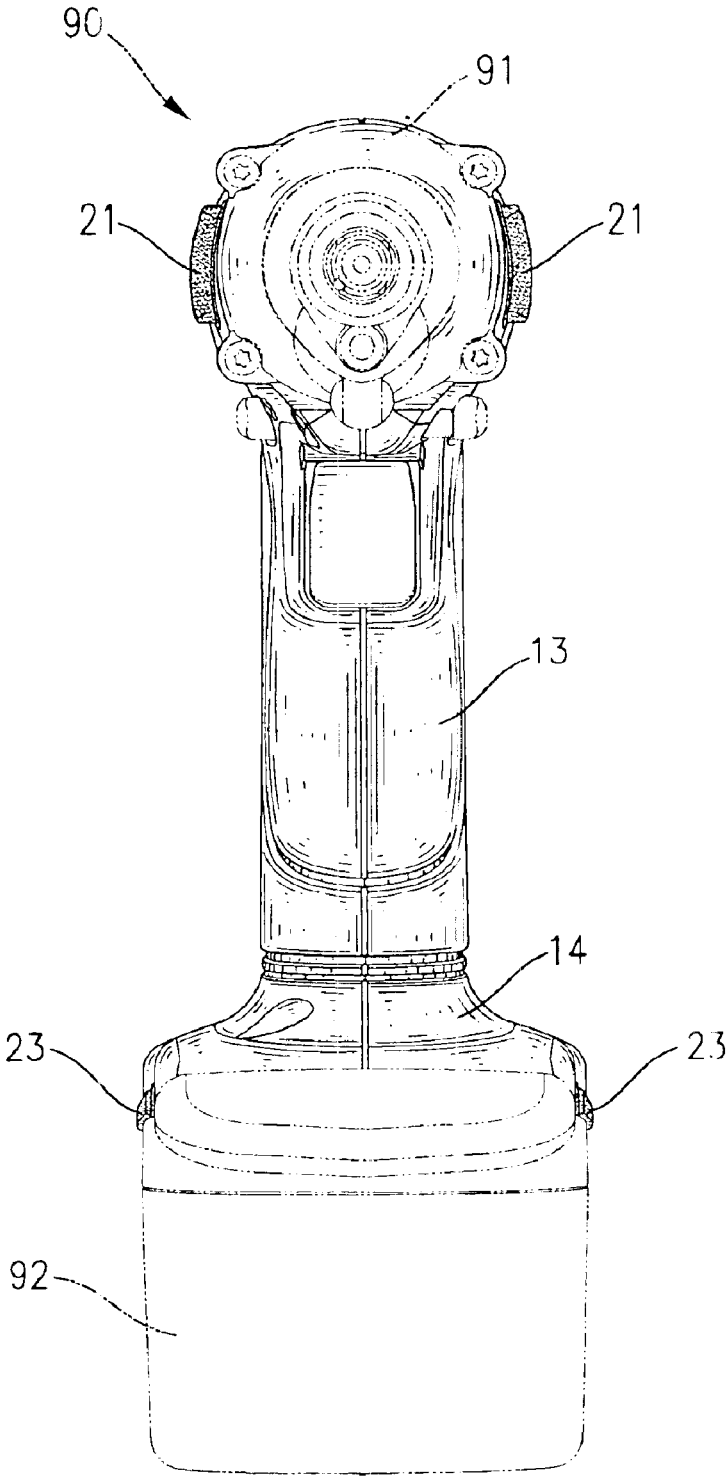
FIG. 5 is a front view of the electrical tool with the tool housing in FIG. 1.

With reference to FIG. 1, a tool housing with protective pads in accordance with the present invention is applied to an electrical tool (90). The electrical tool has a tool head (91), a motor, a transmitting device and a battery (92), wherein the detail structures of the tool head (91), the motor, the transmitting device and the battery (92) are not essential feature of the present invention and conventional and are not further described.

With reference to FIGS. 1 to 5, the tool housing with protective pads in accordance with the present invention comprises a housing body and two protectors.

The housing body encloses the motor of the electrical tool (90) and has two sides, a motor housing body (10) and a handle housing body (13).

The motor housing body (10) has two sides, a front end (11), a back end (12) and a bottom. The handle housing body (13) is formed with and is integrally connected to the bottom of the motor housing body (10) and has two sides and a bottom (14).

The two protectors are mounted respectively on and protrude respectively from the sides of the housing body. Each protector has a first protective pad (21), a second protective pad (22) and a protective pad (23). The first, second and third protective pads (21, 22, 23) are made of elastic material such as rubber and can absorb shocks. The first protective pads (21) are mounted respectively on and protrude respectively from the sides of the motor housing body (10) close to the front end (11) of the motor housing body (10). The second protective pads (22) are mounted respectively on and protrude respectively from the sides of the motor housing body (10) close to the back end (12) of the motor housing body (10). The third protective pads (23) are mounted respectively on and protrude respectively from the side of the handle housing body (13) close to the bottom of the handle housing body (13).

When putting the electric tool (90) on a table or on the floor, the first, second and third protective pads (21, 22, 23) on the same side of the housing body will contact with the table or the floor to keep the housing body separate from the table or the floor. Accordingly, the housing body will be kept from contact with adjacent objects, and wear of the housing body can be prevented. In addition, the protectors of the tool housing in accordance with the present invention can absorb shocks to prevent the housing body from being damaged, such that the motor and the transmitting device held in the housing can also be kept from damage. Accordingly, the useful life of the electrical tool (90) can be prolonged.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A tool housing with protective pads for an electrical tool comprises:

a housing body having two sides;

a motor housing body having two sides, a front end, a back end and a bottom; and a handle housing body formed with and integrally connected to the bottom of the motor housing body and having two sides and a bottom; and two protectors mounted respectively on the sides of the housing body, protruding respectively from the sides of the housing body and each having a first protective pad made of elastic material and mounted on and protruding from one of the sides of the motor housing body close to the front end of the motor housing body;

a second protective pad made of elastic material and mounted on and protruding from the motor housing body at the side on which the first protective pad is mounted and close to the back end of the motor housing body; and a third protective pad made of elastic material and mounted on and protruding from the handle housing body at the side on which the first and second protective pads are mounted and close to the bottom of the handle housing body.

* * * * *